US005459009A

United States Patent [19]

Fukuda et al.

[11] Patent Number: 5,459,009

[45] Date of Patent: Oct. 17, 1995

[54] PROCESS FOR MAKING AN ELECTROPHOTOGRAPHIC PHOTORECEPTOR HAVING PROTECTIVE LAYER

[75] Inventors: Yuzuru Fukuda; Masayuki Nishikawa; Masato Ono; Noriyoshi Takahashi; Shigeru Yagi; Ken-ichi Karakida, all of Kanagawa, Japan

[73] Assignee: Fuji Xerox Co., Ltd., Tokyo, Japan

[21] Appl. No.: 624,533

[22] Filed: Dec. 10, 1990

Related U.S. Application Data

[63] Continuation of Ser. No. 308,214, Feb. 9, 1989, abandoned.

[30] Foreign Application Priority Data

Feb. 10, 1988 [JP] Japan ..... 63-27432
Feb. 10, 1988 [JP] Japan ..... 63-27433

[51] Int. Cl.[6] ..... G03G 5/00

[52] U.S. Cl. ..... 430/127; 430/58; 430/66; 430/67; 430/84; 430/132

[58] Field of Search ..... 430/58, 66, 67, 430/84, 132, 127

[56] References Cited

U.S. PATENT DOCUMENTS 4,477,549 10/1984 Fujimaki ..... 430/57
4,559,289 12/1985 Sunagawa et al. ..... 430/66
4,613,556 9/1986 Mort et al. ..... 430/60 X
4,675,265 1/1987 Kazama et al. ..... 430/57
4,713,309 12/1987 Johncock ..... 430/66 X
4,770,963 9/1988 Pai ..... 430/64
4,801,515 1/1989 Iino ..... 430/57 X

*Primary Examiner*—S. Rosasco
*Attorney, Agent, or Firm*—Finnegan, Henderson, Farabow, Garrett & Dunner

[57] ABSTRACT

A process for producing an electrophotographic photoreceptor comprising the steps of forming a photoconductive layer on a conductive substrate in a reaction chamber, and after the photoconductive layer is formed, forming a surface protection layer on the photoconductive layer by introducing into the reaction chamber a gaseous mixture comprising (i) a first component, fluorohydrocarbon gas, and (ii) a second component silicon, hydride gas, or a hydrocarbon gas and/or hydrogen gas and decomposing the gaseous mixture by glow discharge, wherein the surface protection layer thus formed comprises amorphous silicon carbide when the second component is a silicon hydride gas or amorphous carbon when the second component is a hydrocarbon gas and/or hydrogen gas. The surface protection layer exhibits sufficient hardness to protect the photoconductive layer from frictional scratches and other related damage.

4 Claims, No Drawings

PROCESS FOR MAKING AN ELECTROPHOTOGRAPHIC PHOTORECEPTOR HAVING PROTECTIVE LAYER

This application is a continuation of application Ser. No. 07/308,214, filed Feb. 9, 1989 now abandoned.

BACKGROUND OF THE INVENTION

1. Field of the Invention

The present invention is directed generally to a process for producing an electrophotographic photoreceptor and, more particularly, is directed to a process for producing an electrophotographic photoreceptor comprising a conductive substrate having provided thereon a photoconductive layer comprising amorphous silicon and a surface protection layer comprising amorphous silicon carbide or amorphous carbon.

2. Description of Related Art

A recent development in the art of electro-photographic photoreceptors is a photoreceptor having an amorphous silicon photosensitive layer, and a variety of various amorphous silicon-based electro-photographic photoreceptors have already been proposed. Photoreceptors having an amorphous silicon photosensitive layer are produced by forming an amorphous silicon film on a conductive substrate by, for example, decomposition of silane ($SiH_4$) by glow discharge. The amorphous silicon film contains hydrogen atoms to thereby exhibit photoconductivity. Notwithstanding the fact that amorphous silicon photoreceptors have a high degree of sensitivity to light having wave-lengths of from about 400 to 700 nm, a high level of heat resistance as well as excellent mechanical strength, an additional layer comprising, for example, SiN and SiO, has been proposed as a surface protection layer for the amorphous silicon film. It has been pointed out, however, that such surface protection layers cause blurring of images when subjected to long-term use under high temperature and high humidity conditions. In order to solve this problem, certain electrophotographic photoreceptors have been proposed which have surface layers comprising amorphous silicon carbide, amorphous carbon, or carbon of diamond structure as disclosed in unexamined, published Japanese patent application Nos. JP-A-57-115551, JP-A-57-115556, JP-A-58-88753, JP-A-57-114146, JP-A-60-61761, and JP-A-60-249155.

Amorphous silicon carbide surface layers are generally formed on the photoreceptor surface by glow discharge decomposition of a mixed gas comprising a hydrocarbon gas and a silicon hydride gas, and amorphous carbon surface layers are generally formed on the photoreceptor surface by glow discharge decomposition of a hydrocarbon gas. The surface layers thus formed, however, exhibit a low hardness level as evidenced by low Vickers hardness values which range from about 300 to 400 (load=10 g). Accordingly, the surface of such photoreceptors tend to be susceptible to physical deformation and alteration during use as a result of frictional contact with the blade used for scraping residual toner and/or contact with a pawl used for releasing paper. Once the surface integrity of the photoreceptor is broken, image quality becomes reduced and defective electrophotographic copies having streaks and similar faults result.

SUMMARY OF THE INVENTION

Accordingly an object of the present invention is to provide an electrophotographic photoreceptor having an amorphous silicon photoconductive layer and a hard surface protection layer having excellent physical strength and integrity.

The present invention overcomes the problems and disadvantages of the prior art by providing a novel process for producing an electrophotographic photoreceptor having an amorphous silicon photoconductive layer and a surface protection layer comprising amorphous silicon carbide or amorphous carbon which exhibits superior hardness and physical integrity.

Another object of the present invention is to provide an electrophotographic photoreceptor having an amorphous silicon photoconductive layer and a hard surface protection layer having excellent frictional resistance.

Additional objects and advantages of the present invention will be set forth, in part, in the description which follows and, in part, will be obvious from the description or may be learned by practice of the invention. The objects and advantages of the invention may be learned by and attained by means of the instrumentalities and combination of steps particularly pointed out in the appended claims.

To achieve the foregoing objects, and in accordance with the purpose of the present invention, as embodied and broadly described herein, the process of producing an electrophotographic photoreceptor in accordance with the present invention comprises the steps of forming a photoconductive layer comprising amorphous silicon on a conductive substrate, and after this photoconductive layer is formed, forming a surface protection layer on the photoconductive layer by introducing into a reaction chamber a gaseous mixture comprising (i) a first component, fluorohydrocarbon gas, and (ii) a second component, silicon hydride gas, or a hydrocarbon gas and/or hydrogen gas, and decomposing the gaseous mixture by glow discharge, wherein the surface protection layer comprises amorphous silicon carbide when the second component is a silicon hydride gas or amorphous carbon when the second component is a hydrocarbon gas and/or hydrogen gas.

DETAILED DESCRIPTION OF THE INVENTION

Reference will now be made, in detail, to preferred embodiments of the present invention.

Conductive substrates which may be used in the present invention include sheets of metals such as aluminum, nickel, chromium; sheets of alloys such as stainless steel; plastic or glass sheets having conductive films; and paper sheets which have been treated and rendered conductive.

The amorphous silicon photoconductive layer may be formed on the conductive substrate by glow discharge decomposition of a reactive gas comprising a silicon compound. More specifically, a reactive gas comprising a silicon compound is introduced into a reaction chamber of a plasma chemical vapor deposition (CVD) apparatus, and the reactive gas is decomposed by glow discharge to deposit an amorphous silicon photoconductive layer onto the surface of the conductive substrate which is located at a predetermined location within the reaction chamber. Examples of silicon compounds which are suitable for use in forming the amorphous silicon photoconductive layer include $SiH_4$, $Si_2H_6$, $SiCl_4$, $SiHCl_3$, $SiH_2Cl_2$, $Si(CH_3)_4$, $Si_3H_8$, and $Si_4H_{10}$.

If desired, the silicon compound may be mixed with a carrier gas such as hydrogen, helium, argon, and neon. For the purpose of improving the electrophotographic characteristics of the amorphous silicon photosensitive layer, the reactive gas may further comprise a dopant gas such as, for example, diborane or phosphine. The flow rates of the carrier gas and the dopant gas are generally from 0 to 20 times and from 0 to 0.05 times, respectively, the volume of the silicon compound.

The glow discharge decomposition of the reactive gas may be carried out using alternating current (AC) discharge having a power frequency of from about 0.1 to 30 MHz and, more preferably, from about 5 to 20 MHz, under a reaction chamber pressure of from about 0.1 to 5 Torr, and while the temperature of the substrate is maintained between about 100° C. and 400° C. The actual thickness of the photoconductive layer deposited on the substrate is not critical, but is generally between about 1 micron and 200 microns and, more preferably, between 10 microns and 100 microns.

In the present invention, the photoconductive layer which is formed on the conductive substrate generates a charge carrier. The strength of the charge carrier is proportional to and depends on the amount of light exposed to and received by the photoconductive layer.

The photoreceptor of the present invention may further comprise a charge transporting layer and/or a charge blocking layer which forms a barrier to the charge carrier between the conductive substrate and the photoconductive layer, as described in U.S. Pat. No. 4,770,963.

According to the present invention, a surface layer comprising amorphous silicon carbide or amorphous carbon is formed on top of the amorphous silicon photoconductive layer. This surface layer functions as a protective layer for the amorphous silicon photoconductive layer.

In order to form a surface protection layer of an amorphous silicon carbide or an amorphous carbon on top of the amorphous silicon photoconductive layer, a gaseous mixture comprising a fluorohydrocarbon (a first component) and a silicon hydride (a second component) as the primary components or a gaseous mixture comprising the first component and a hydrocarbon and/or hydrogen (a second component) as the primary components is used as a starting gas. The mixing ratio of the first component to the second component is selected appropriately and, preferably, is between about 20:1 and about 1:20 and more preferably between about 15:1 and 1:15, in terms of flow rate (by volume).

The fluorohydrocarbon to be used preferably includes those represented by the following formulas (I) to (III):

$$C_lH_{2l+2-x}F_x \quad \text{(I)}$$

$$C_mH_{2m-y}F_y \quad \text{(II)}$$

$$C_nH_{2n-2-z}F_z \quad \text{(III)}$$

wherein l represents an integer of from 1 to 20 and preferably from 1 to 5; m and n, each represents an integer of from 2 to 20 and preferably from 2 to 5; x represents an integer of from 1 to 2n+2; y represents an integer of from 1 to 2n; and z represents an integer of from 1 to 2n−2.

Specific examples of suitable fluorohydrocarbons include $CH_3F$ (fluoromethane), $CH_2F_2$ (difluoromethane), $CHF_3$ (fluoroform), $CF_4$ (tetrafluoromethane), $C_2H_5F$ (fluoroethane), $C_2H_4F_2$ (difluoroethane), $C_2F_6$ (perfluoroethane), $C_2H_3F$ (fluoroethylene), $C_3H_5F$ (allyl fluoride), and $C_3F_4$ (tetrafluoroallene), with $CH_3F$, $C_2H_5F$ and $C_2H_3F$ being preferred.

The silicon hydride to be used preferably includes those represented by the formula, $$Si_pH_{2p+2},$$

wherein p represents an integer of from 1 to 4.

Preferred examples of specific hydrocarbons which are suitable include paraffinic hydrocarbons having from 1 to 20 carbon atoms and preferably from 1 to 10 carbon atoms, such as methane, ethane, propane, and n-butane; olefinic or acetylenic hydrocarbons having from 2 to 20 carbon atoms and preferably from 2 to 10 carbon atoms, such as ethylene, propylene, butene-1, butene-2, isobutylene, acetylene and methylacetylene; alicyclic hydrocarbons having from 3 to 20 carbon atoms and preferably from 3 to 10 carbon atoms, such as cyclopropane, cyclobutane, cyclopentane, cyclohexane, and cyclobutane; and aromatic hydrocarbons having from 6 to 20 carbon atoms and preferably from 6 to 12 carbon atoms, such as benzene, toluene, xylene, naphthalene, and anthracene.

The above-described raw materials for the formation of a surface protection layer may be gaseous, solid or liquid at room temperature. If liquid or solid raw materials are used, however, they should be introduced into the reaction chamber in a gaseous form.

The surface protection layer of the present invention may be formed by glow discharge decomposition of the starting gaseous mixture using a plasma CVD apparatus. The glow discharge may be conducting using either direct current (DC) or alternating current (AC). For example, when alternating current (AC) is used for conducting glow discharge decomposition to form a surface protection layer on the amorphous silicon photoconductive layer, the frequency employed is usually in a range between about 0.1 and 30 MHz and, preferably, between about 5 and 20 MHz; the degree of vacuum at the time of discharging is typically between 0.1 and 5 Torr (13.3 and 667 Pa); and the temperature of the substrate is typically maintained between about 50° C. and 500° C. and, preferably, between about 100° C. and 300° C.

The actual thickness of the surface protection layer deposited on the amorphous silicon photoconductive layer is not critical, but is generally between about 0.01 micron and 10 microns and, preferably, between about 0.2 micron and 5 microns.

According to the process of the present invention, since the surface layer of amorphous silicon carbide or amorphous carbon is formed by using a fluorohydrocarbon gas, hydrogen atoms generated by glow discharge decomposition become bonded to fluorine atoms and generate hydrogen fluoride, which is driven out of the reaction system. As a result, it is presumed that the amount of hydrogen gas which becomes incorporated in the surface protection layer is considerably reduced. Accordingly, the hardness of the surface protection layer is increased.

The present invention will now be explained in greater detail by way of the following examples and comparative examples. The following examples and comparative examples are given only with the intention of further explaining the spirit of the present invention, and it is to be understood that the scope and breadth of the present invention as claimed in the appended claims is not to be limited thereby.

EXAMPLE 1

A cylindrical substrate made of aluminum was placed in a predetermined position of a capacitively-coupled type plasma CVD apparatus which enables formation of an amorphous silicon film on the cylindrical substrate. A mixed gas consisting of silane ($SiH_4$), diborane ($B_2H_6$), and hydrogen ($H_2$) was introduced into the reaction chamber and subjected to glow discharge decomposition to thereby form an amorphous silicon charge blocking layer having a thickness of 2 microns and an amorphous silicon photoconductive layer having a thickness of 20 microns on the surface of the aluminum substrate.

The charge blocking layer was formed under the following conditions.

| | |
|---|---|
| 100% Silane gas flow rate: | 200 $cm^3$/min |
| 300 ppm $H_2$-diluted diborane flow rate: | 200 $cm^3$/min |
| Inner pressure: | 0.8 Torr |
| Discharge power: | 180 W |
| Discharge time: | 40 min |
| Discharge frequency: | 13.56 MHz |
| Substrate temperature: | 250° C. |

The photoconductive layer was formed under the following conditions.

| | |
|---|---|
| 100% Silane gas flow rate: | 200 $cm^3$/min |
| 100 ppm $H_2$-diluted diborane flow rate: | 5 $cm^3$/min |
| Hydrogen flow rate: | 195 $cm^3$/min |
| Inner pressure: | 0.8 Torr |
| Discharge power: | 180 W |
| Discharge time: | 400 min |
| Discharge frequency: | 13.56 MHz |
| Substrate temperature: | 250° C. |

The reaction chamber was then evacuated, and a mixed gas consisting of carbon tetrafluoride ($CF_4$) and silane ($S_iH_4$) was introduced therein and decomposed by glow discharge to form a 0.5 micron-thick surface protection layer comprising amorphous silicon carbide as the primary component on the photoconductive layer.

The surface protection layer was formed under the following conditions.

| | |
|---|---|
| Carbon tetrafluoride flow rate: | 40 $cm^3$/min |
| Silane flow rate: | 16 $cm^3$/min |
| Inner pressure: | 0.5 Torr |
| Discharge power: | 200 W |
| Discharge time: | 60 min |
| Discharge frequency: | 13.56 MHz |
| Substrate temperature: | 250° C. |

A Vickers hardness test of the surface protection layer formed in Example 1 revealed a hardness of 780 kg/$cm^2$ under a load of 10 g.

The resulting electrophotographic photoreceptor was loaded in a copying machine, and copying was carried out according to a positive corona charging system. After 50,000 copies were made in an atmosphere of 20° C. and 60% RH, an atmosphere of 35° C. and 85% RH, or an atmosphere of 5° C. and 15% RH, the next copies obtained in the respective atmosphere were visually evaluated for image quality. The images thus examined were free of faults such as blurring, reduction in density, and streaks typically caused by cleaning blades or paper release pawls.

EXAMPLE 2

An electrophotographic photoreceptor was produced in the same manner as in Example 1, producing a charge blocking layer of about 2 microns thick and a photoconductive layer of about 20 microns thick on a cylindrical aluminum substrate, with both layers comprising amorphous silicon as the primary component. Afterwards, a 0.5 micron-thick surface protection layer was formed on the photoconductive layer in the same manner as in Example 1, except a gaseous mixture of perfluoroethane ($C_2F_6$) and silane ($S_iH_4$) was used as the reactive gas. The surface protection layer was formed under the following conditions.

| | |
|---|---|
| Perfluoroethane flow rate: | 40 $cm^3$/min |
| Silane flow rate: | 24 $cm^3$/min |
| Inner pressure: | 0.5 Torr |
| Discharge power: | 200 W |
| Discharge time: | 30 min |
| Discharge frequency: | 13.56 MHz |
| Substrate temperature: | 250° C. |

A Vickers hardness test of the surface protection layer formed in Example 2 revealed a hardness of 720 kg/$cm^2$ under a load of 10 g.

In the same manner as in Example 1, the resulting electrophotographic photoreceptor was loaded in a copying machine, and copying was carried out. The images thus obtained were free of faults such as blurring, reduction in density, and streaks typically caused by cleaning blades or paper release pawls.

EXAMPLE 3

An electrophotographic photoreceptor was produced in the same manner as in Example 1, producing a charge blocking layer of about 2 microns thick and a photoconductive layer of about 20 microns thick on a cylindrical aluminum substrate, with both layers comprising amorphous silicon as the primary component, except that the layers were produced under different conditions as shown below. The charge blocking layer was formed under the following conditions.

| | |
|---|---|
| 100% Silane gas flow rate: | 200 $cm^3$/min |
| 300 ppm $H_2$-diluted diborane flow rate: | 200 $cm^3$/min |
| Inner pressure: | 1.0 Torr |
| Discharge power: | 200 W |
| Discharge time: | 30 min |
| Discharge frequency: | 13.56 MHz |
| Substrate temperature: | 250° C. |

The photoconductive layer was formed under the following conditions.

| | |
|---|---|
| 100% Silane gas flow rate: | 200 $cm^3$/min |
| 100 ppm $H_2$-diluted diborane flow rate: | 5 $cm^3$/min |
| Hydrogen flow rate: | 195 $cm^3$/min |
| Inner pressure: | 1.0 Torr |
| Discharge power: | 200 W |
| Discharge time: | 300 min |
| Discharge frequency: | 13.56 MHz |
| Substrate temperature: | 250° C. |

The reaction chamber was then evacuated, and a mixed gas consisting of carbon tetrafluoride ($CF_4$) and methane gas ($CH_4$) was introduced therein and decomposed by glow discharge to form a 0.5 micron-thick surface protection layer comprising amorphous carbon as the primary component on the photoconductive layer.

The surface protection layer was formed under the following conditions.

| | |
|---|---|
| Carbon tetrafluoride flow rate: | 40 $cm^3$/min |
| Methane flow rate: | 16 $cm^3$/min |
| Inner pressure: | 0.5 Torr |
| Discharge power: | 200 W |
| Discharge time: | 120 min |
| Discharge frequency: | 13.56 MHz |
| Substrate temperature: | 250° C. |

A Vickers hardness test of the surface protection layer formed in Example 3 revealed a hardness of 950 kg/$cm^2$ under a load of 10 g, showing a very hard surface protection layer.

In the same manner as in Example 1, the resulting electrophotographic photoreceptor was loaded in a copying machine, and copying was carried out. The images thus obtained were free of faults such as blurring, reduction in density, and streaks typically caused by cleaning blades or paper release pawls.

EXAMPLE 4

An electrophotographic photoreceptor was produced in the same manner as in Example 1, producing a charge blocking layer of about 2 microns thick and a photoconductive layer of about 20 microns thick on a cylindrical aluminum substrate, with both layers comprising amorphous silicon as the primary component.

The reaction chamber was then evacuated, and a mixed gas consisting of perfluoroethane ($C_2F_6$) and hydrogen was introduced therein and decomposed by glow discharge to form a 0.5 micron-thick surface protection layer comprising amorphous carbon as the primary component on the photoconductive layer. The surface protection layer was formed under the following conditions.

| | |
|---|---|
| Perfluoroethane flow rate: | 40 $cm^3$/min |
| Hydrogen flow rate: | 16 $cm^3$/min |
| Inner pressure: | 0.5 Torr |
| Discharge power: | 200 W |
| Discharge time: | 120 min |
| Discharge frequency: | 13.56 MHz |
| Substrate temperature: | 250° C. |

A Vickers hardness test of the surface protection layer formed in Example 4 revealed a hardness of 800 kg/$cm^2$ under a load of 10 g, showing a very hard surface protection layer.

In the same manner as in Example 1, the resulting electrophotographic photoreceptor was loaded in a copying machine, and copying was carried out. The images thus obtained were free of faults such as blurring, reduction in density, and streaks typically caused by cleaning blades or paper release pawls.

COMPARATIVE EXAMPLE 1

An electrophotographic photoreceptor was produced in the same manner as in Example 1, producing a charge blocking layer of about 2 microns thick and a photoconductive layer of about 20 microns thick on a cylindrical aluminum substrate, with both layers comprising amorphous silicon as the primary component.

The reaction chamber was then evacuated, and a mixed gas consisting of methane ($CH_4$) and silane ($S_iH_4$) was introduced therein and decomposed by glow discharge to form a 0.5 micron-thick surface protection layer comprising amorphous carbon as the primary component on the photoconductive layer.

The surface protection layer was formed under the following conditions.

| | |
|---|---|
| Methane flow rate: | 100 $cm^3$/min |
| Silane flow rate: | 20 $cm^3$/min |
| Inner pressure: | 0.5 Torr |
| Discharge power: | 200 W |
| Discharge time: | 30 min |
| Discharge frequency: | 13.56 MHz |
| Substrate temperature: | 250° C. |

A Vickers hardness test of the surface protection layer formed in Comparative Example 1 revealed a hardness of 470 kg/$cm^2$ under a 10 g load.

As in Example 1, the resulting electrophotographic photoreceptor of Comparative Example 1 was loaded in a copying machine, and copying was carried out according to a positive corona charging system. After 1,500 copies were made in an atmosphere of 20° C. and 60% RH, the next copies obtained were visually evaluated for image quality. The images thus examined were observed to suffer from image defects due to scratches caused by cleaning blades or paper release pawls.

COMPARATIVE EXAMPLE 2

An electrophotographic photoreceptor was produced in the same manner as in Example 1, producing a charge blocking layer of about 2 microns thick and a photoconductive layer of about 20 microns thick on a cylindrical aluminum substrate, with both layers comprising amorphous silicon as the primary component.

In the same manner as in Example 3, the reaction chamber was then evacuated, and a reactive gas solely consisting of methane ($CH_4$) was introduced therein and decomposed by glow discharge to form a 0.5 micron-thick surface protection layer.

The surface protection layer was formed under the following conditions.

| | |
|---|---|
| Methane flow rate: | 40 $cm^3$/min |
| Inner pressure: | 0.5 Torr |
| Discharge power: | 200 W |
| Discharge time: | 60 min |
| Discharge frequency: | 13.56 MHz |
| Substrate temperature: | 250° C. |

A Vickers hardness test of the surface protection layer formed in Comparative Example 2 revealed a hardness of 380 kg/$cm^2$ under a 10 g load.

As in Example 1, the resulting electrophotographic photoreceptor of Comparative Example 2 was loaded in a copying machine, and copying was carried out according to a positive corona charging system. After 1,000 copies were made in an atmosphere of 20° C. and 60% RH, the next copies obtained were visually evaluated for image quality. The images thus examined were observed to suffer from image defects due to scratches caused by cleaning blades and/or the paper release pawls.

As described above, the surface protection layer produced according to the process of the present invention has a very high surface hardness as evidenced by having a hardness as measured by a Vickers hardness test of more than 500 $kg/cm^2$. Hence, the electrophotographic photoreceptor of the present invention is protected from friction and scratches typically caused by toner cleaning blades and/or paper release pawls and like components during electro-photographic processing. Further, the electrophotographic photoreceptor of the present invention faithfully provide copies having a blur-free image irrespective of the environmental conditions.

It will be apparent to those skilled in the art that various modifications and variations can be made in the method or process of the present invention without departing from the scope of spirit of the invention. Thus, it is intended that the present invention cover the modifications and variations of this invention provided they come within the scope of the appended claims and their equivalents.

What is claimed is:

1. A process for producing an electrophotographic photoreceptor comprising the steps of forming a photoconductive layer comprising amorphous silicon on a conductive substrate, and after said photoconductive layer is formed, forming a surface protection layer, having a Vickers hardness of more than 500 $Kg/cm^2$ on said photoconductive layer by contacting said photoconductive layer in a reaction chamber with a gaseous mixture consisting of (i) a first component, fluorohydrocarbon gas, and (ii) a second component, hydrocarbon gas, and decomposing said gaseous mixture by glow discharge, said surface protection layer comprising amorphous carbon.

2. A process for producing an electrophotographic photoreceptor according to claim 1, wherein said first component fluorohydrocarbon gas is a member selected from the group consisting of fluorohydrocarbons represented by formulas (I), (II) and (III), $$C_lH_{2l+2-x}F_x \quad \text{(I)}$$

$$C_mH_{2m-y}F_y \quad \text{(II)}$$

$$C_nH_{2n-2-z}F_z \quad \text{(III)}$$

wherein l represents an integer of from 1 to 20; m and n, each represents an integer of from 2 to 20; x represents an integer of from 1 to 2n+2; y represents an integer of from 1 to 2n; and z represents and integer of from 1 to 2n–2.

3. A process for producing an electrophotographic photoreceptor according to claim 1, wherein the ratio of said first component fluorohydrocarbon gas to said second component hydrocarbon is from 20:1 to 1:20 as measured by flow rate of said gases.

4. The product formed by the process of claim 1.

* * * * *